United States Patent [19]

Chen

[11] Patent Number: 4,487,343

[45] Date of Patent: Dec. 11, 1984

[54] GARMENT HANGER

[76] Inventor: Thomas Chen, Fl. 5, 24, Lane 33, Tei-Shiang Rd., Taipei, Taiwan

[21] Appl. No.: 446,207

[22] Filed: Dec. 2, 1982

[51] Int. Cl.[3] ..... A47J 51/082; A47J 51/095

[52] U.S. Cl. ..... 223/85; 223/88; 223/92; D6/319

[58] Field of Search ..... 223/85, 88, 92, 91, 223/93; 211/116, 118; D6/247, 256; 190/115; 206/284, 289

[56] References Cited

U.S. PATENT DOCUMENTS

| | | | |
|---|---|---|---|
| 1,867,614 | 7/1932 | Cuscaden | 223/88 |
| 2,527,642 | 10/1950 | McWhorter | 223/88 |
| 2,611,517 | 9/1952 | Simonsen | 223/88 |
| 3,516,523 | 6/1970 | Pemberton, Jr. | 190/115 X |
| 3,687,277 | 8/1972 | Spencer et al. | 223/92 X |
| 3,702,166 | 11/1972 | Jaffe | 223/85 |

FOREIGN PATENT DOCUMENTS

| | | | |
|---|---|---|---|
| 1429243 | 5/1969 | Fed. Rep. of Germany | 223/88 |

*Primary Examiner*—Robert R. Mackey
*Attorney, Agent, or Firm*—Holman & Stern

[57] ABSTRACT

A garment hanger comprises an assembly of a handle extending in the opposite direction of a hook from a pivot in the hanger. The position of the hook and handle can be changed with each other so that one of them is toward the upper part of hanger. This structure has the double function of hanging and carrying.

8 Claims, 5 Drawing Figures

GARMENT HANGER

BACKGROUND OF THE INVENTION

1. Field Of The Invention

This invention relates to clothes hangers.

The function of the hanger of this invention is to avoid folding and wrinkling in order to keep garments straightened and beautiful and it can also be used for drying garments in the air. The hanger supports clothes similar to a human when wearing them.

2. Description Of The Prior Art

The shape and the material quality of hangers are very important to the garment and can effect the shape thereof. Normally, suits and overcoats are heavier and most hangers are made of wooden, acrylic, or other hard material which is stiff and is not easy to transport because the whole weight of the garment is carried by putting two or three fingers in the hook of the hanger, which is an overload to the fingers. After washing, the weight of the garment will be increased by the water and it is more inconvenient for carrying.

BRIEF SUMMARY OF THE INVENTION

For this reason, the invention provides a new hanger with a hook and handle which makes it more portable and overcomes the above-mentioned defects of the conventional clothes hanger.

BRIEF DESCRIPTION OF THE DRAWINGS

The invention will now be described in detail with reference to the accompanying drawings wherein.

DETAILED DESCRIPTION OF THE INVENTION

Figure 1:
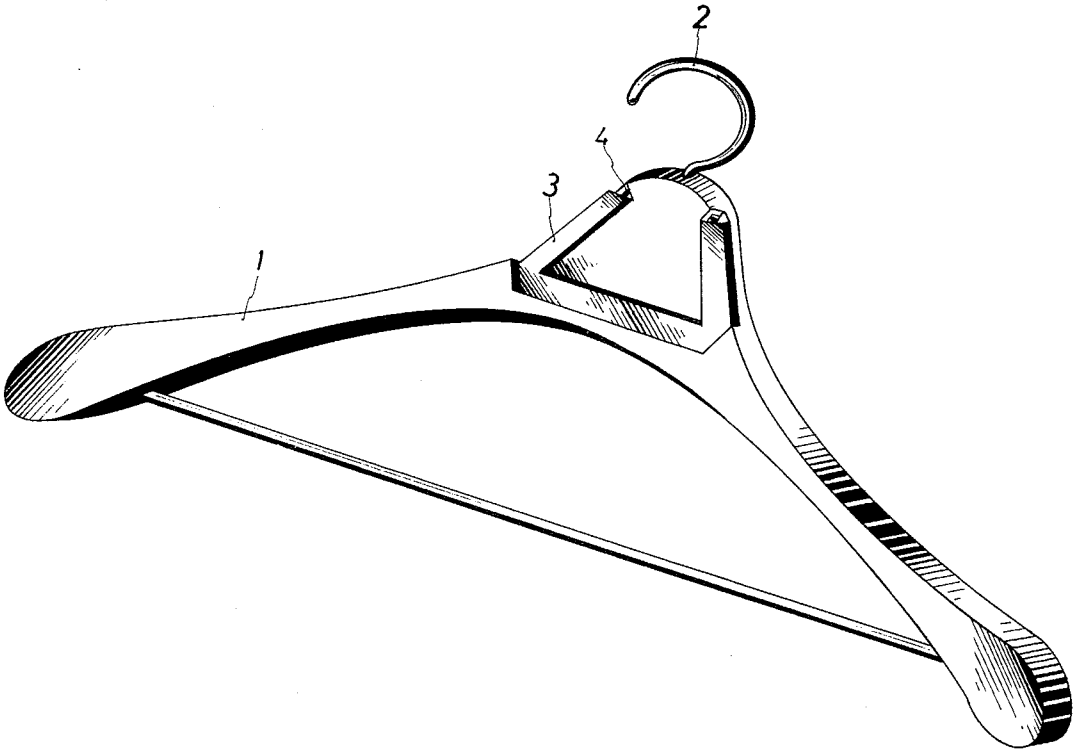
FIG. 1 is a perspective view of the invention.
Figure 3:
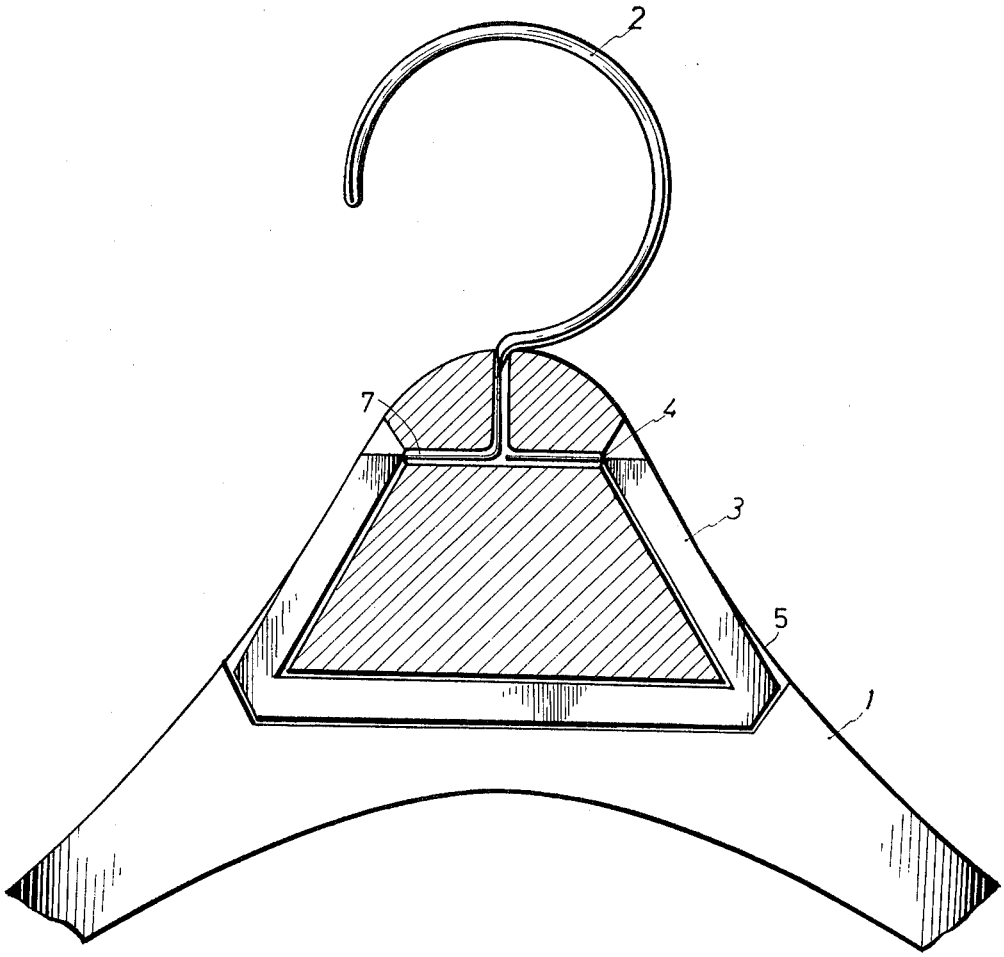
FIG. 3 is an enlarged cross-sectional view of the invention showing the relationship between the hanger body, pivot, hook and handle.
Figure 2:
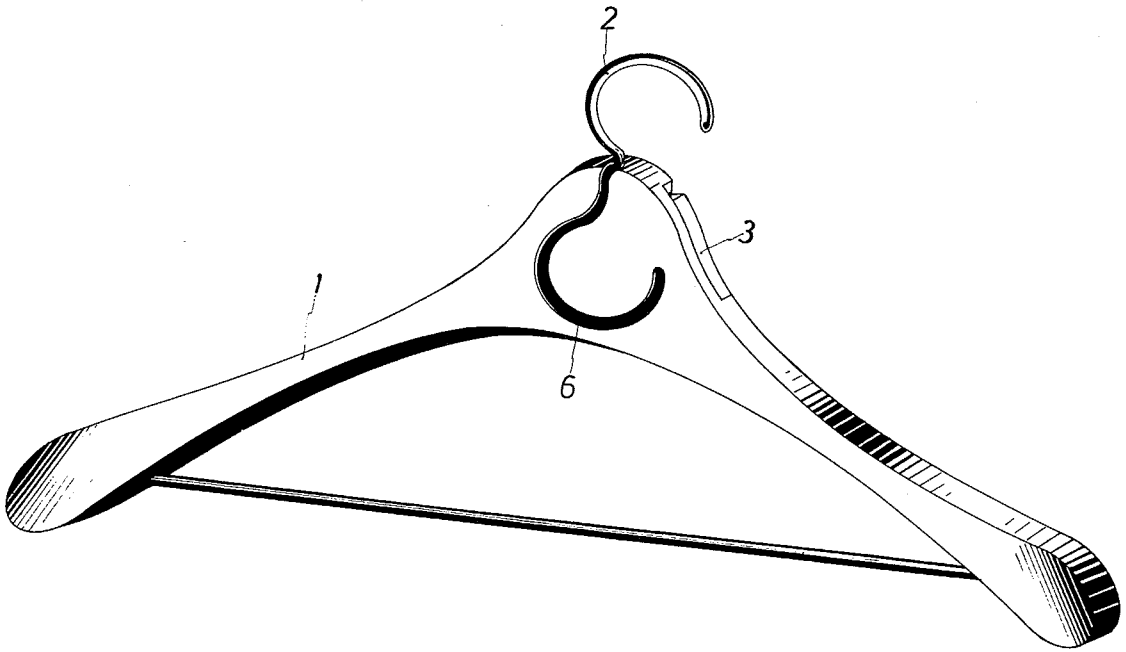
FIG. 2 also is a perspective view of the invention from the opposite side of FIG. 1.

FIGS. 1 and 2 show the invention as mainly comprising triangle shaped hanger body 1, hook 2, handle 3 and pivot 4. FIG. 3 shows the relationship between the hook and handle; as shown, the hook, handle and pivot are portions of the same element, such as a steel wire bent to form these portions, so that hook 2 and handle 3 extend in two opposite directions from pivot 4. Hook 2 is shown in FIG. 3 on the hanger body 1 at the upper part of the pivot; the handle with a U-shape is at the lower part of the pivot 4 and is upside down in the groove 5 (refer to FIG. 4) which is in the hanger body 1 and has the same shape as the handle.

Groove 5 is formed in the upper part of hanger body 1 to provide a U-shaped notch on one side of the hanger body conforming to the shape of the handle and a bore or hollow tubular opening or bearing portion 7 is provided for supporting the pivot portion 4 of the hook, handle and pivot member for rotation. The hook and handle portions are symmetrical with respect to the center of the pivot portion.

Figure 4:
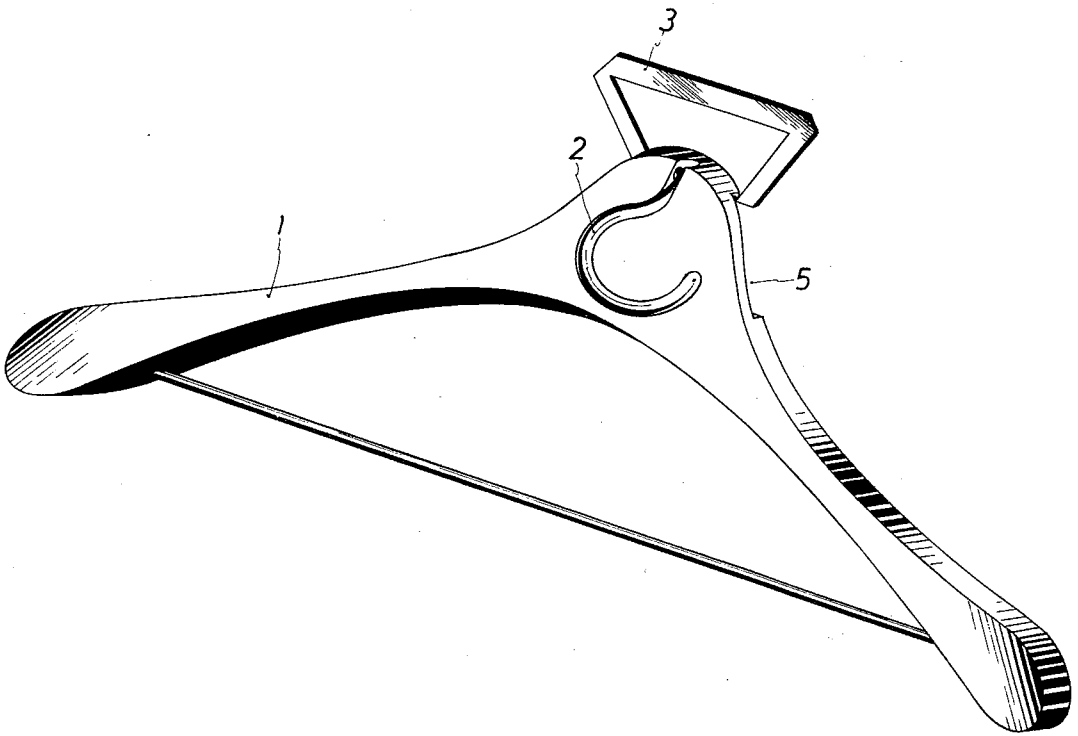
FIG. 4 is a perspective view of the invention showing the handle and hook rotated through an angle of 180 degrees.

FIG. 4 shows on the opposite side to U-shaped groove 5 upside down groove 6 (refer to FIG. 2) which has the same shape as hook 2. When U-shaped handle 3 rotates from groove 5 to the upper part of hanger 1, the hook 2 rotates into the groove 6 on the back side of the hanger (i.e., the pivot rotates 180 degrees). When the hanger of the invention is hung in the closet, hook 2 will be turned upward and it can be turned downwardly if the hanger is used for carrying when handle 3 is upward for a hand to grasp, whereby the weight will not be concentrated on the fingers and will not have a painful effect on the fingers. When clothing is hung on the hanger to be dried in the air, handle 3 is put through a bamboo rod, or similar element, for avoiding the hanger being blown down by wind. This kind of hanger can be obtained in a tailor's store, or a laundry, for it is convenient for the customers when they take the article such as a cleaned suit or overcoat home.

Figure 5:
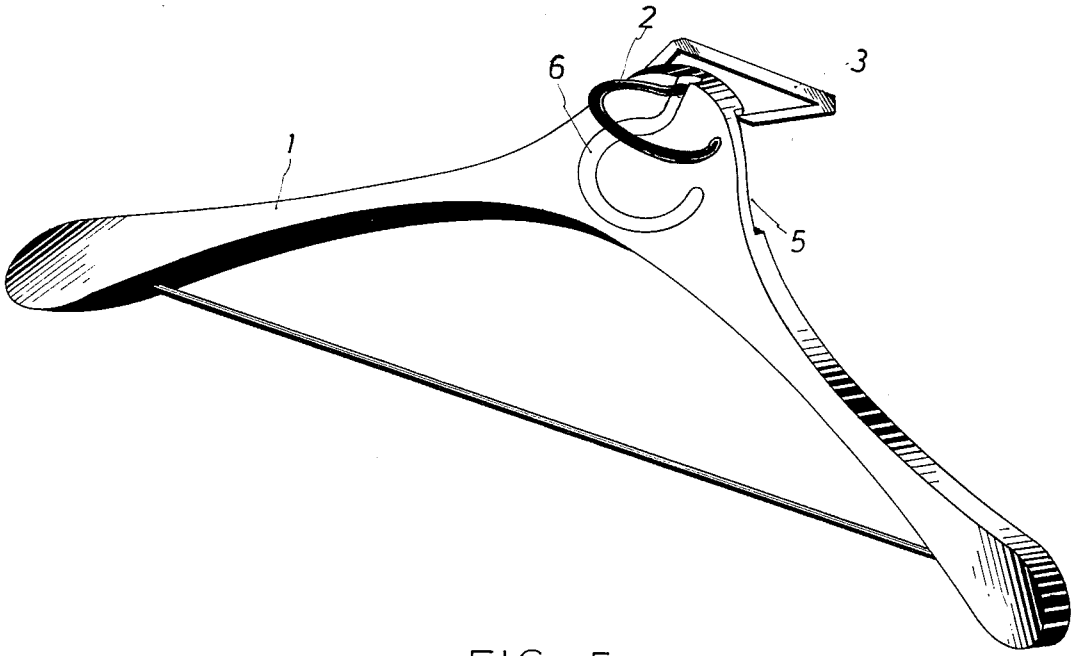
FIG. 5 is a view similar to FIG. 4 showing the handle and hook rotated through an angle of 90 degrees.

FIG. 5 shows the pivot rotated through an angle of 90 degrees. As shown in the figure, handle 3 can be used for carrying, and can also be turned to a suitable angle keeping hook 2 toward the upper part of hanger 1 and additional clothing such as a necktie, waistband, scarf or similar article can be hung on handle 3 so that when handle 3 is moved down in groove 5 it is prevented from slipping off.

From the above description, it can be seen that the invention has novelty and practical value and is simple to manufacture, the cost is low and it can be readily produced to supply the need of the market.

I claim:

1. A garment hanger comprising:

a hanger body having upwardly converging arms on which a garment may be supported joined at an upper part;

a U-shaped handle groove in one side of said upper part;

a tubular pivot opening extending through said upper part between the upper ends of the legs of said U-shaped groove;

a hook shaped groove in the other side of said upper part, the uppermost part of which extends through the top of said upper part and communicates with said pivot opening;

a pivot element rotatably mounted within said pivot opening;

a hook element conforming to the shape of said hook-shaped groove for interfitting engagement therein extending from said pivot element through said hook-shaped groove; and a U-shaped handle element conforming to said U-shaped groove for interfitting engagement therein having its legs extending from the ends of said pivot element in a direction substantially opposite to the plane of said hook element;

so that said hook and handle elements are rotatable about said pivot from a position wherein said hook element extends upwardly from said hanger body when said handle element is in said U-shaped groove to a position wherein said handle element extends upwardly from said hanger body when said hook element is in said hook-shaped groove.

2. A garment hanger as claimed in claim 1 wherein said hook-shaped groove comprises:

a substantially straight shank portion at said uppermost part thereof and a part circular portion extending from the lower end of said straight portion.

3. A garment hanger as claimed in claim 2 wherein said substantially straight shank portion intersects with said pivot opening substantially at the midpoint between the ends of said pivot opening.

4. A garment hanger as claimed in claim 3 wherein said hook, handle and pivot elements are portions of a single integral member.

5. A garment hanger as claimed in claim 1 wherein said hook-shaped groove intersects with said pivot opening substantially at the midpoint between the ends of said pivot opening.

6. A garment hanger as claimed in claim 1 wherein said hook, handle and pivot elements are portions of a single integral member.

7. A garment hanger as claimed in claim 6 wherein said single integral member is a steel wire bent to form said respective portions, said pivot portion comprising a section of said wire between said midpoint and one end of said pivot opening and a section at the end of said wire between said midpoint and the other end of said pivot opening.

8. A garment hanger as claimed in claim 1 wherein said hanger body is a solid member.

* * * * *